US005118657A

United States Patent [19]

Kawakami et al.

[11] Patent Number: 5,118,657

[45] Date of Patent: Jun. 2, 1992

[54] DYE TRANSFER TYPE THERMAL PRINTING SHEETS

[75] Inventors: Tetsuji Kawakami; Hiromu Matsuda, both of Katano; Keiichi Yubakami, Suita; Akihiro Imai; Nobuyoshi Taguchi, both of Ikoma, all of Japan

[73] Assignee: Matsushita Electric Industrial Co., Ltd., Osaka, Japan

[21] Appl. No.: 413,176

[22] Filed: Sep. 26, 1989

[30] Foreign Application Priority Data

Sep. 30, 1988 [JP] Japan ..... 63-248195
Apr. 14, 1989 [JP] Japan ..... 1-95748

[51] Int. Cl.[5] ..... B41M 5/035; B41M 5/26

[52] U.S. Cl. ..... 503/227; 8/471; 428/195; 428/212; 428/327; 428/421; 428/447; 428/500; 428/913; 428/914

[58] Field of Search ..... 8/471; 428/195, 212, 428/913, 914, 327, 421, 447, 500; 503/227

[56] References Cited

U.S. PATENT DOCUMENTS

| | | | |
|---|---|---|---|
| 4,623,580 | 11/1986 | Koshizuka et al. | 428/216 |
| 4,724,288 | 2/1988 | Hann | 503/227 |
| 4,880,768 | 11/1989 | Mochizuki et al. | 503/227 |
| 4,902,669 | 2/1990 | Matsuda et al. | 503/227 |

FOREIGN PATENT DOCUMENTS

| | | | |
|---|---|---|---|
| 0192435 | 2/1986 | European Pat. Off. | 503/227 |
| 0201940 | 2/1986 | European Pat. Off. | 503/227 |
| 0210838 | 7/1986 | European Pat. Off. . | |
| 1049894 | 3/1986 | Japan | 503/227 |
| 1148095 | 7/1986 | Japan | 503/227 |
| 63-27291 | 2/1988 | Japan | 503/227 |
| 63-194983 | 8/1988 | Japan | 428/488.4 |
| 63-199679 | 8/1988 | Japan | 428/488.4 |
| 1-110194 | 4/1989 | Japan | 503/227 |

OTHER PUBLICATIONS

Patent Abstracts of Japan, vol. 11, No. 82 (M-571)(2529) 12 Mar. 1987, & JP-A-61 237688 (Ricoh Co. Ltd.) 22 Oct. 1986.

Patent Abstracts of Japan, vol. 11, No. 48 (M-561)(2495) 13 Feb. 1987, & JP-A-61 211094 (Hitachi Ltd.) 19 Sep. 1986.

Patent Abstracts of Japan, vol. 10, No. 291 (M-522)(2347) 3 Oct. 1986, & JP-A-61 106296 (Dainippon Printing Co. Ltd.) 24 May 1986.

H. Sato et al., Journal of the Institute of Image Electronics Engineers, 16(5), 280-286 (1987).

Y. Murata, "Material for Information Recording System", Academic Publication Center (1989), pp. 127-146.

H. Matsuda et al., "Partially Reusable Printing Characteristics of Dye Transfer Type Thermal Printing Sheets" in Collected Papers of Proceedings of 2nd Non-impact Printing Technologies Symposium, pp. 101-104 (1985).

T. Shimizu et al., "Multi-Usable Sublimation Dye Sheets" National Convention Record of the Institute of Image Electronics Engineers (Jun. 1986) pp. 1-4.

H. Matsuda et al., "Multi-Usable Dye Transfer Sheets" Advanced Printing of Paper Summaries of the 30th Anniversary Conference of the Society of Electrophotography of Japan, pp. 266-269.

*Primary Examiner*—Bruce H. Hess

*Attorney, Agent, or Firm*—Stevens, Davis, Miller & Mosher

[57] ABSTRACT

A dye transfer sheet consisting of a transfer substrate and a coloring material layer comprising a high concentration layer which comprises a dye and is formed on the transfer substrate and a low concentration layer which comprises a water soluble resin or water dispersible resin having a polydimethylsiloxane structure and has a lower dye concentration than the high concentration layer and is formed on the high concentration layer. A dye transfer sheet consisting of a transfer substrate and a coloring material layer comprising a high concentration layer which comprises a dye and a binder polymer cross-linked with a cross-linking agent and is formed on the transfer substrate and a low concentration layer which comprises a water soluble resin or water dispersible resin and has a lower dye concentration than the high concentration layer and is formed on the high concentration layer. The dye transfer sheet of the present invention can be used in a multiple-use mode printing system including a relative speed printing.

5 Claims, 2 Drawing Sheets

DYE TRANSFER TYPE THERMAL PRINTING SHEETS

The present invention relates to a dye transfer sheet for multiple-use mode printing where the dye transfer sheet is repeatedly used in the same place thereof in a thermal dye transfer Printing system where a dye is transferred from the dye transfer sheet to a dyeing layer of a dye receiving sheet to print a picture.

A thermal dye transfer printing system using a highly subliming dye is a full-color printing system which enables a density-gradient printing at each of Printed dots. This system, however, has a drawback in that a dye transfer sheet is expensive. Therefore, there has been tried the multiple-use mode printing where a dye transfer sheet is repeatedly used.

In order to achieve a full-color printing equal to ordinary printing, that is single-use mode Printing, in the multiple-use mode printing, the same saturated optical density of a printed dot (about 1.5–1.8) is required as in the ordinary printing Also, the optical density is required not to be affected by a printing history (the number of times of repeating printing, etc.) when the same printing energy is exerted.

The examples of multiple-use mode printing are reported in "Partially Reusable Printing Characteristics of Dye Transfer Type Thermal Printing Sheets" in Collected Papers of Proceedings of 2nd Non-impact Printing Technologies Symposium, pages 101–104 (1985) (Reference 1) and "Multi-usable Sublimation Dye Sheets" in National Convention Record of the Institute of Image Electronics Engineers (June 1986) (Reference 2). The above References 1 and 2 deal with the characteristics of the multiple-use mode printing in a relative speed system where a dye transfer sheet is moved at a running speed relative to a thermal head, smaller than a dye receiving sheet is. The multiple-use mode printing system is classified into the simple repeating system where the same portion of a dye transfer sheet is repeatedly used N times and the n-times mode relative speed system where a dye transfer sheet runs at 1/n of the running speed at which a dye receiving sheet runs that substantially enables multiple-use mode printing of n times at the same portion of the dye transfer sheet.

The relative speed system can achieve printing in substantially more times than the simple repeating system since new portions of the dye transfer sheet are continuously provided, though some contrivances are necessary for good lubrication between the dye transfer sheet and the dye receiving sheet.

In the system of Reference 1, spherical spacer particles are put between a dye transfer sheet and a dye receiving sheet to achieve an optical density of about 1.8 when the number of times of repeating printing, n, is 12. In the system the necessary conditions relating to the above noted saturated optical density and influence by a printing history is fulfiled by a sufficient amount of dye required for multiple-use mode printing in points of printing characteristics. Usable dyes are, however, restricted to highly subliming ones since lubrication properties must be given between a dye transfer sheet and a dye receiving sheet to enable running at a relative speed and further since a space must be secured between them to control the amount of the transferred dye by a sublimation process.

In the system of Reference 2, a dye transfer sheet and a dye receiving sheet run contacting closely with each other to achieve an optical density of about 1.0 when n is 10. Also, in this system, it is possible to use a low subliming and highly weather-resistant dye because of a close contact diffusion transfer. An optical density is, however, decreased as increase in number of times of repeating printing when the same printing energy is exerted, even if a sufficient amount of a dye is secured for multiple-use mode printing. As a result, a saturated optical density does not reach a practical level.

Further, Japanese Patent Application Kokai No. 63-27291 (Reference 3) is recited as one of prior art references. In the system of this reference, a resin obtained by cross-linking a binder polymer with an isocyanate is used as a coloring material layer to enable relative speed printing. Also, a solid lubricant having a particle size of 0.1–1 μm such as polyethylene powder, molybdenum disulfide or the like is added to the coloring material layer. In this system, printing sensitivity is deteriorated as compared with a system containing no spacer. Further, when the particle size of the spacer is small, an optical density is considerably decreased with increase in ratio of running speeds of two sheets.

On the other hand, a new material constitution is disclosed in "MULTI-USABLE DYE TRANSFER SHEETS" in Advance Printing of Paper Summaries of the 30th Anniversary Conference of The Society of Electrophotography of Japan, pages 266–269 (Reference 4). In the system of this reference, decrease in dye concentration is suppressed at the surface of a coloring material layer by controlling the diffusibility of a dye in the coloring material layer and the dyeing layer of a dye receiving sheet or by forming a gradiation of dye concentration in the direction of thickness of the coloring material layer in advance thereby enabling multiple-use mode printing. Since there is used the dye transfer sheet which has, on a transfer substrate, a coloring material layer comprising a dye not having high sublimation and a binder polymer and having a lower dye concentration by weight at the surface of the layer than on the side of the substrate of the layer, the same portion of the dye transfer sheet can be subjected to multiple-use mode printing in a close contact diffusion transfer. However, when low dye concentration layers are formed by applying an organic solution of an oil-soluble resin, another low dye concentration layer flows out which has been formed previously. Therefore, it is difficult to keep a dye concentration low at the surface of the coloring material layer. In this system, good properties of multiple-use mode printing are not completely exhibited which would be expected originally. Also, a dye transfer sheet is likely to weld together with the dyeing layer of a dye receiving sheet to cause difficulty in relative speed printing since spherical spacer particles are not used in the system. Since, in order to enable the relative speed printing, there is added to a coloring material layer a lubricant such as a derivative of a fatty acid having not a very large molecular weight, a wax or silicone oil which is liquid at the vicinity of room temperature or the like, the dye is recrystallized at the surface of the coloring material layer to deteriorate the dye transfer sheet in shelf life and the lubricant is transferred to the surface of the dye receiving sheet to deteriorate a printed picture in weather resistance and the like.

In a high dye concentration layer, a thermoplastic resin having a low heat deformation temperature which can fully diffuse a dye is used as a binder polymer in order to improve properties of multiple-use mode printing. A dye concentration is high and the thickness of the layer is large. Therefore, the high dye concentration layer is trailed by the dyeing layer of the dye receiving sheet to be deformed in heating conditions of the printing. When the high dye concentration layer is trailed, the portion of a coloring material layer becomes thin which is to contribute to the printing successively. In this case, an optical density cannot be obtained in proportion to a printing signal since a sufficient amount of a dye is not held and further nonuniformity of optical density occurs on the whole printed picture owing to the deformation of the coloring material layer.

The present inventors have found that when a dye transfer sheet is made by forming first a high dye concentration layer (hereinafter referred to as high concentration layer) comprising a dye and thereafter a dye-permeable low dye concentration layer (hereinafter referred to as low concentration layer) comprising a water soluble resin or water dispersible resin and having a lower dye concentration than the above-mentioned high concentration layer on a transfer substrate, the abovementioned problems can be solved by (A) using a water soluble resin or water dispersible resin having a polydimethylsiloxane structure (hereinafter this polymer compound being referred to as a polydimethyl-siloxane-containing polymer in some places) which the top layer of the dye transfer sheet is composed of; or (B) cross-linking the binder polymer which the high concentration layer comprises with a cross-linking agent.

The present invention relates to a dye transfer sheet consisting of a transfer substrate and a coloring material layer comprising a high concentration layer which comprises a dye and is formed on the transfer substrate and a low concentration layer which comprises a water soluble resin or water dispersible resin having a polydimethylsiloxane structure and has a lower dye concentration than the high concentration layer and is formed on the high concentration layer. Further, the present invention relates to a dye transfer sheet consisting of a transfer substrate and a coloring material layer comprising a high concentration layer which comprises a dye and a binder polymer cross-linked with a cross-linking agent and is formed on the transfer substrate and a low concentration layer which comprises a water soluble resin or water dispersible resin and has a lower dye concentration than the high concentration layer and is formed on the high concentration layer.

An object of the present invention is to provide a dye transfer sheet for multiple-use mode printing.

Other objects and advantages of the invention will become apparent from the following description.

Figure 1:
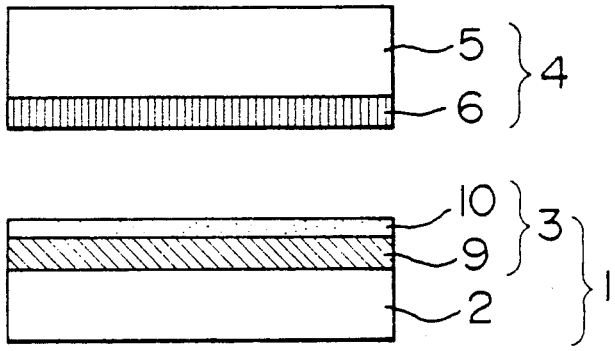
FIG. 1 is schematic cross-sectional pictures of a dye transfer sheet in one preferred mode of the present invention and a dye receiving sheet.

First, the principle is explained on which printing characteristics of multiple-use mode printing including a relative speed system are improved in the dye transfer sheet of the present invention which sheet is constituted by forming first a high concentration layer comprising a dye and thereafter a low concentration layer comprising a water soluble resin or water dispersible resin and having a lower dye concentration than the high concentration layer on a transfer substrate.

When printing is conducted with a dye transfer sheet and a dye receiving sheet contacting closely with each other, the transfer of the dye is attributed to the diffusion of the dye between the coloring material layer of the dye transfer sheet and the dyeing layer of the dye receiving sheet. Paying attention to a change in dye concentration at the surface of the coloring material layer in the conventional process of consuming the dye in multiple-use mode printing, the dye existing near said surface is consumed and the dye concentration at said surface is reduced to almost half a dye concentration in the inner part of the coloring material layer after the first printing, since a gradient of dye concentration is not formed in the inner part of the coloring material layer at the initial state. From the second printing, the dye is supplied also from the inner part in proportion to the gradient of dye concentration. Therefore, the decreasing rate of a dye concentration becomes very small at the surface of the coloring material layer. Accordingly, in the multiple-use mode printing where the same printing energy is exerted, optical density is sharply decreased from the first printing to the second one and thereafter it is less decreased.

In the present invention, however, a dye concentration by weight is rendered lower on the side of the surface of the coloring material layer than on the side of the transfer substrate of said layer to form a gradient of dye concentration in the inner part of the layer. Thereby, a dye is supplied from the inner part of the coloring material layer from the first printing and, as a result, a sharp decrease in optical density is avoided at the initial stage of the printing.

The dye transfer sheet of the present invention is easily made by forming first a high concentration layer on a transfer substrate and then applying thereon an aqueous coating comprising a water soluble resin or water dispersible resin to form a low concentration layer.

Secondly, the above two preferred modes (A) and (B) of the present invention are explained more particularly:

(A) A polydimethylsiloxane-containing polymer has a low surface energy and is hard to be stuck or adhered to the surfaces of the other polymers. Also, a cohesion state of the polymer is not broken even at a higher temperature than the melting point and the surface energy does not become high, unlike the above-mentioned coloring material layer containing a derivative of a higher fatty acid. It is considered that the surface energy is kept low even at a high temperature.

Since a portion having a polydimethylsiloxane structure is bonded to a main polymer chain through a covalent bond, the portion does not shift in the binder polymer which a coloring material layer comprises nor transfer to the dyeing layer of the dye receiving sheet.

In the mode of the present invention, a high concentration layer is formed on a transfer substrate and then a low concentration layer is formed by applying thereon an aqueous coating comprising a polydimethylsiloxane-containing polymer as a water soluble resin or water dispersible resin. Thereby a sharp decrease in optical density can be avoided at the initial stage of the printing. Also, even if a thermal printing is conducted at a high temperature and the relative speed between a dye transfer sheet and a dye receiving sheet is high, a surface energy at the coloring material layer is kept low and the dye receiving sheet is easy to slide on the dye transfer sheet to enable a relative speed printing thanks to a portion having a polydimethylsiloxane structure. Further, since the polydimethylsiloxane does not transfer to the dyeing layer of the dye receiving sheet when heating, a bad influence is not exerted on a printed picture on the dye receiving sheet.

(B) In this preferred mode (B), the binder polymer which a high concentration layer comprises is cross-linked and hardened by a cross-linking agent to increase the mechanical strength of the high concentration layer. Thereby the high concentration layer can resist deformation by a shearing stress and reproducibility of gradient is secured to obtain a good quality of picture of no nonuniformity in optical density.

Some embodiments of the present invention are explained below.

First, an embodiment of the above preferred mode (A) is explained.

In the conventional process of applying coatings having different dye concentrations and similar compositions of solvents repeatedly, a high concentration layer formed previously is dissolved in a coating applied thereafter whereby a dye concentration in a low concentration layer to be formed thereafter is increased. Therefore, the conventional process cannot achieve good characteristics of a multiple-use mode printing.

A dye transfer sheet of the present invention is made by forming first a high concentration layer comprising a dye and thereafter a low concentration layer comprising a water soluble resin or water dispersible resin and having a lower dye concentration than said high concentration layer on a transfer substrate.

An example of the dye transfer sheet of the present invention is shown in FIG. 1. A dye transfer sheet 1 is constituted by providing a high concentration layer 9 and a low concentration layer 10 in this order on a transfer substrate 2. The high concentration layer 9 and the low concentration layer 10 together constitute a coloring material layer 3. A dye receiving sheet 4 is constituted by providing a dyeing layer 6 on a receiving substrate 5.

In such a multiple-layered composition, a dye concentration by weight in the low concentration layer is preferably half or less a dye concentration by weight in the high concentration layer. A thickness of the low concentration layer can controlled to be most effective depending upon a ratio of a dye concentration in the low concentration layer to one in the high concentration layer. That is to say, the low concentration layer is rendered thick when the ratio is high and thin when it is low. When a dye concentration in the low concentration layer is near zero, a thickness thereof is preferably 1 $\mu$m or less. Also, a thickness of the low concentration layer can be controlled to be highly effective depending upon the dye permeability of the resin which the low concentration layer comprises. That is to say, the low concentration layer is rendered thin when the resin has a relatively small dye permeability and thick when it has a large dye permeability.

Also, since the low concentration layer serves as a protective layer of the high concentration layer in said multiple-layered composition, a dye inferior in shelf life can be added to the high concentration layer in a content of 50% by weight or more. The dye transfer sheet can hold a large amount of dye efficiently thereby keeping a dye concentration high in the coloring material layer after more times of printing and achieving printing of high optical density in which optical density does not greatly change.

A dye can be held in the low concentration layer by adding the dye in advance to a coating and applying it. Also, a dye can be held in the low concentration layer by providing more heat energy than enough for vaporizing a solvent in a drying process of the low concentration layer applied and thereby diffusing the dye from the high concentration layer to the low concentration layer.

When a running speed of the dye transfer sheet is smaller than one of the dye receiving sheet relative to a thermal head, the decrease in optical density caused by increase in ratio of both running speeds, that is n, can be suppressed also in the multiple-use mode printing of a relative speed system wherein the dye in the coloring material layer is transferred to the dyeing layer of the dye receiving sheet by heating selectively the dye transfer sheet from the back side of the dye transfer sheet or dye receiving sheet thereby forming a picture on the dye receiving sheet. This relative speed system causes less damage by thermal printing to a portion of the dye transfer sheet contributing to the printing than the multiple-use mode printing of the simple repeating system and therefore has less influence on quality of picture.

Figure 2:
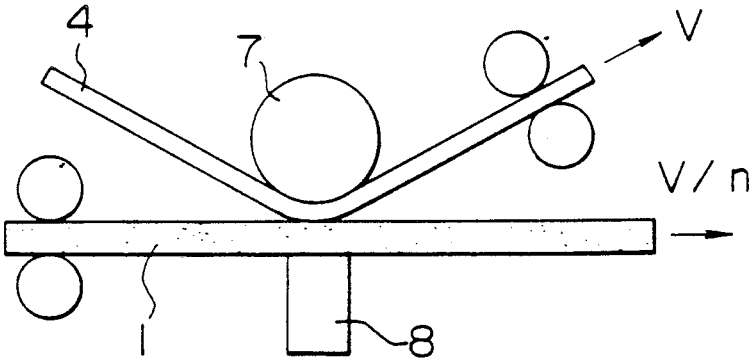
FIG. 2 is a scheme of a relative speed system in one preferred mode of the present invention.

A scheme of the relative speed system is shown in FIG. 2.

The dye transfer sheet 1 and the dye receiving sheet 4 are pressed on the thermal head 8 by a platen 7 to contact the coloring material layer 3 with the dyeing layer 6 closely. When a speed of the dye receiving sheet 4 relative to the thermal head 8 is v, a speed of the dye transfer sheet 1 is v/n (n=1, 2, 3 . . . ). The dye transfer sheet can run either in the same direction as or the opposite direction to the dye receiving sheet. Since the dye transfer sheet is, however, heated by the thermal head and hence the coloring material layer of the dye transfer sheet is likely to weld to the dyeing layer of the dye receiving sheet, both or any of the coloring material layer and the dyeing layer should have sufficient lubricity.

Figure 3:
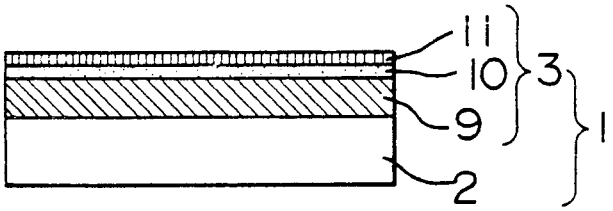
FIG. 3 is a schematic cross-sectional picture of a dye transfer sheet in another preferred mode of the present invention.

In the present invention, after the high concentration layer is formed on the transfer substrate 2, the lubricity can be provided by applying thereon an aqueous coating comprising a polydimethylsiloxane-containing polymer. Thereby, the dye transfer sheet can be made which has lubricity at the surface of the coloring material layer. Also, after the low concentration layer is formed using a water soluble resin or water dispersible resin, the lubricity can also be imparted to the low concentration layer by applying thereon a polydimethyl-siloxane-containing polymer, which polymer itself also serves as a low concentration layer. This constitution is shown in FIG. 3. This process is particularly effective for improving the shelf life of the dye transfer sheet.

Further, in order to impart lubricity, it is also effective to add microparticles having not a very large size compared with the thickness of the low concentration layer.

When using the dye transfer sheet of the present invention the coloring material layer of which closely contacts with the dyeing layer of the dye receiving sheet, the multiple-use mode printing including a relative speed system is possible in which the initial decrease in optical density is small.

Next, another preferred mode (B) of the present invention is explained below.

The lubricity can be provided by, for example, using a polydimethylsiloxane-containing polymer in the low concentration layer as in the above preferred mode (A) or adding a lubricant such as a wax, a reactive silicone oil or the like to the low concentration layer. In the high concentration layer, however, a thermoplastic resin having a low heat deformation temperature which can fully diffuse a dye is used as a binder polymer in order to improve properties of multiple-use mode printing. A dye concentration is high and the thickness of the layer is large. Therefore the high concentration layer is trailed by the dyeing layer to be deformed. When it is trailed, the portion of the coloring material layer becomes thin which is to contribute to the printing. In this case, an optical density cannot be obtained in proportion to a printing signal since a sufficient amount of the dye is not held and further nonuniformity of optical density occurs on the whole printed picture owing to the deformation of the coloring material layer.

In carrying out the preferred mode (B), the binder polymer which the high concentration layer comprises is cross-linked with a cross-linking agent. This cross-linking improves the mechanical strength of the high concentration layer and prevents the layer from deformation by shearing stress exerted in the relative speed system. Therefore the reproducibility of gradient is good and a good quality of picture can be achieved which has no nonuniformity of optical density. The increase of the mechanical strength by the cross-linking is more effective in the high concentration layer having a large thickness than in the low concentration layer.

Using the dye transfer sheet of the present invention, it is possible to achieve multiple-use mode printing of a relative speed system in which the initial decrease in optial density is small and the reproducibility of gradient and quality of picture is good.

Specific materials used in the present invention are explained below.

Heating methods for dye transfer include a method of using a thermal head, a method of turning on electricity, a method of heating in a heat mode using laser and the like but should not be restricted thereto. Therefore depending upon a heating method, different transfer substrates and receiving substrates can be used. For example, when a thermal head is used, there are used as transfer substrates ester-type polymers such as polyethylene terephthalate, polyethylene naphthalate, polycarbonates and the like; amide-type polymers such as nylons and the like; cellulose derivatives such as acetyl cellulose, cellophane and the like and imide-type polymers such as polyimides, polyamide imides, polyether imides and the like. At the surface of the transfer substrate with which surface the thermal head contacts, a heat resistant layer or lubricating layer is formed if necessary. Also, when printing is conducted by turning on electricity or by induction heating, there are used films of the abovementioned materials to which electroconductivity is imparted.

Dyes include disperse dyes, basic dyes, dyeformers of basic dyes and the like.

In the preferred mode (A), binder polymers are not particularly restricted and include polyester resins, butyral resins, formal resins, nylon resins, polycarbonate resins, urethane resins, chlorinated polyethylenes, chlorinated polypropylenes, (meth)acrylic resins, polystyrene resins, AS resins, polysulfone resins, polyphenylene oxide, cellulose derivatives and the like. These are selected according to necessary properties and used alone or in combination.

In the preferred mode (B), binder polymers are not particularly restricted so far as they are crosslinked and hardened with a cross-linking agent, and include saturated polyesters, polyvinyl butyrals, polyvinyl formals, polyvinyl acetals, polyamides, modified polycarbonates, polyurethanes, modified (meth)acrylic resins and the like. From a viewpoint of a cross-linking reaction, there are preferably used saturated polyesters, polyvinyl formals, polyvinyl acetals, polyvinyl butyrals and the like which have many hydroxyl groups and hence are able to react with isocyanates as cross-linking agents without heating. They are selected according to necessary properties and used alone or in combination. In order to improve the properties of the multiple-use mode printing, generally, thermoplastic resins are preferably used which have high permeability of dyes and heat deformation temperatures (according to ASTM D648) or glass transition temperatures (according to ASTM D1043) of 50–150° C.

Cross-linking agents are not particularly restricted and include polymethylol ureas, melamine resins such as polymethylol melamines and the like, polyaldehydes such as glyoxal and the like, epoxy resins, phenol resins, polyisocyanates and the like. Polyisocyanates are preferably used since they develop cross-linking easily at room temperature.

A high concentration layer comprises at least a dye, binder polymer and a cross-linking agent if necessary and can further comprise various auxiliaries such as a lubricant, a dye dispersant and the like. When it comprises a silicone compound, a wax and the like as a lubricant, a surface free energy becomes small and hence it is difficult to apply successively an aqueous coating having a relatively high surface free energy. Therefore, attention should be paid to the addition of such a lubricant to the high concentration layer.

A high concentration layer can be easily formed, in the preferred mode (A), by applying a solution of a binder polymer comprising a dye (hereinafter this solution is referred to as an ink) on a transfer substrate and drying the coated substrate and, in the preferred mode (B), by applying an ink further comprising a cross-linking agent on a transfer substrate and drying the coated substrate and subjecting the binder polymer to cross-linking reaction during or after drying.

Solvents, used in preparing an ink for the formation of the high concentration layer, include alcohols such as methanol, ethanol, propanol, butanol and the like; cellosolves such as methylcellosolve, ethylcellosolve and the like; aromatic hydrocarbons such as benzene, toluene, xylene and the like; esters such as butyl acetate and the like; ketones such as acetone, 2-butanone, cyclohexanone and the like; nitrogen-containing compounds such as N,N-dimethylformamide and the like and halogenated hydrocarbons such as dichloromethane, chlorobenzene, chloroform and the like. However, in the preferred mode (B), those inert to cross-linking agents should be used of the above-mentioned solvents. For example when isocyanates are used as cross-linking agents which react with alcoholic hydrogen atom, alcohols and cellosolves cannot be used as solvents.

An ink can be applied on a transfer substrate with a reverse roll coater, a gravure coater, a rod coater, an air doctor coater and the like and thereby the high concentration layer is formed.

In the case of the low concentration layer and the lubricating layer, a method for applying a coating is the same as mentioned above.

A thickness of the high concentration layer depends upon a dye concentration, the number of times of repeating printing, a relative speed and an amount per unit area of the dye that should be transferred to the dye receiving sheets to get a desired maximum optical density (usually 1.5–1.8). It is to be desired that the thickness is controlled to hold at least the minimum dye coated weight calculated by the following equation:

Minimum dry coated weight ($g/m^2$) =

[Number of times of repeating printing] ×

[Amount of dye] ($g/m^2$)/[Percentage by weight of dye]

Water soluble resins and water dispersible resins, used in the preferred mode (B), are not particularly restricted so far as they have moderate dye permeabilities, and include (partially saponificated) polyvinyl alcohols, water soluble polyamides, polyacrylamide and its derivatives, water soluble or dispersible polyesters, various ionomer resins, celluloses, gelatin, poly(meth)acrylic acid, metal salts thereof, water soluble or dispersible polyurethane resins, water soluble or dispersible acrylic resins and the like.

In the preferred mode (A), polydimethylsiloxane-containing polymers are used as water soluble resins or water dispersible resins. The polydimethylsiloxane-containing polymers are defined as polymer compounds comprising portions having polydimethylsiloxane structures, and include graft copolymers and block copolymers of polydimethylsiloxane and the like. As polymers of main chains, there are used addition polymerization-type vinyl resins such as acrylic resins, polyvinyl acetate and the like, condensation polymerization-type resins such as polyester resins and the like, polyaddition-type resins such as polyurethane resins and the like. As polydimethylsiloxane-containing polymers of addition polymerization-type resins, there are enumerated a partially saponified graft polymer of polydimethylsiloxane on polyvinyl acetate, a graft polymer of polydimethylsiloxane on poly(meth)acrylate and the like. As polydimethylsiloxane-containing polymers of condensation polymerization-type resins, there are exemplified polyesters and polyamides using silicone diols or silicone diamines, and the like. As polydimethyl-siloxane-containing polymers of polyaddition-type resins, there are enumerated polyurethanes using silicone diols, and the like. These polymers preferably have glass transition temperatures higher than room temperature so that a dye can moderately diffuse in the printing and a low concentration layer does not adhere to the back side of the dye transfer sheet on a reel.

In the preferred mode (A), the low concentration layer can further comprise the other water soluble resins or water dispersible resins used in the preferred mode (B). However, since a diffusion rate of a dye is small, for example, in a polyvinylalcohol obtained by saponifying polyvinyl acetate and a homopolymer of acrylic acid, a sufficient optical density cannot be obtained when these polymers are mainly used in the low concentration layer of large thickness. Also in the case, the variation of thickness has had influence on printing sensitivity and properties of multiple-use mode printing.

Therefore in any of the preferred modes (A) and (B), there are used polyvinyl alcohol obtained by saponifying polyvinyl acetate in a degree of saponification of 30–90%, water soluble or dispersible polyester resins, water soluble or dispersible polyurethane resins, water soluble or dispersible acrylic resins and the like.

Also, the low concentration layer can comprise a lubricant and the like. Lubricants are not particularly restricted so far as they can dissolve or be emulsified in an aqueous coating, and include microparticles, various silicone oils, waxes, derivatives of fatty acids and the like. Attention should be, however, paid to the use of silicone oils, waxes and derivatives of fatty acids since they have had influence on printed pictures as stated above. Types of microparticles are not particularly restricted. Microparticles of polytetrafluoroethylene are preferably used which have low surface energies.

An aqueous coating is used for forming the low concentration layer. As solvents other than water of the aqueous coating, there can be used alcohols, ketones, cellosolves and the like.

A thickness of the low concentration layer depends upon a diffusion rate of a dye in a water soluble resin or water dispersible resin used, a dye concentration, a printing energy, the number of times of repeating printing and a ratio of running speeds of two sheets, that is n. When the number of repeating printing or the ratio n is in the order of tens, a thickness is preferably in a range of 0.1–1 $\mu m$.

A dye receiving sheet usually consists of a receiving substrate 5 and a dyeing layer 6.

As transparent receiving substrates, there are used various films such as polyester and the like. As white receiving substrates, there are used synthetic paper or coated paper consisting mainly of polyester, polypropylene or the like, ordinary paper and the like. These substrates are selected and used according to objects.

A dyeing substance is used in a dyeing layer 6. Dyeing substances, used in th dyeing layer 6, include thermoplastic resins such as polyesters, polyamides, acrylic resins, acetate resins, various cellulose derivatives, starch, polyvinyl alcohol and the like; and hardening resins which are cured with heat, light, electron beam and the like such as acrylic acid, acrylates, polyesters, polyurethanes, polyamides, acetates and the like. They are selected and used alone or in combination according to objects.

According to the present invention, there is provided a dye transfer sheet capable of a relative speed printing and excellent in shelf life and weather resistance of printed pictures which does not cause sharp decrease in dye concentration at the surface of a coloring material layer and hence in optical density even if the number of times of repeating printing is increased in multiple-use mode printing.

In the dye transfer sheet of the present invention, it is possible to use a highly weather-resistant and low subliming dye, which is practical. The dye transfer sheet of the present invention can provide a high saturated optical density of printed pictures even after many times of printing and enables a full-color printing exhibiting the same reproducibility of gradient and quality of picture as in an ordinary single-use mode printing, at a low running cost in multiple-use mode printing.

The present invention is explained more specifically below referring to the Examples and Comparative Examples.

In the following Examples and Comparative Examples, there was commonly used as a transfer substrate an aromatic polyamide film of 6 μm in thickness which had a heat resistant lubricating layer on the back side. A dye receiving sheet was made by applying a coating obtained by dissolving 10 g of an ultraviolet-curable resin (SP5003 made by SHOWA HIGHPOLYMER CO., LTD.), 0.1 g of a sensitizer (IRGACURE made by Ciba-Geigy (Japan) Limited) and 0.05 g of an amide-modified silicone oil (KF 3935 made by Shin-Etsu Chemical Co., Ltd.) in 10 g of toluene on a sheet of white synthetic paper made of PET as a receiving substrate with a wire bar and then drying the obtained sheet with hot wind and curing the ultraviolet-curable resin for 1 minute with a 1 kW high pressure mercury lamp thereby forming a dyeing layer. Used was a

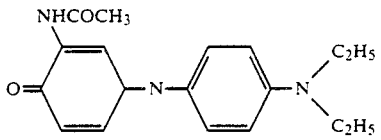

I

As a printing measure was used a thermal head. Printing conditions were as follows:

Printing cycle : 16.7 ms/line
Printing pulse width : 4.0 ms (max)
Resolution : 6 line/mm
Printing energy : 6 J/cm$^2$ (variable)
Running speed of dye transfer sheet : 1.0 mm/s (in the case of a relative speed system) 10.0 mm/s (in the case of a simple repeating system)
Running speed of dye receiving sheet : 10.0 mm/s Example 1 (in the preferred mode (A))

The ink obtained by dissolving 2 g of the dye I and 2 g of a butyral resin (S-lec BX-1 made by Sekisui Chemical Co., Ltd.) as a binder polymer in a mixed solvent of 21 g of toluene and 9 g of MEK was applied on a transfer substrate with a wire bar so as to secure a dry coated weight of 3 g/m$^2$ and then dried thereby forming a high concentration layer.

On the other hand, 2 parts by weight of a macromonomer obtained by introducing vinyl silane on one end of a terminal diol-type polydimethylsiloxane having a molecular weight of about 5,600 was subjected to radical copolymerization with 98 parts by weight of vinyl acetate. Thereafter 60% by mole of vinyl acetate was saponified to obtain the partially formed polyvinyl alcohol on which polydimethylsiloxane was grafted. 2 g of the obtained partially formed polyvinyl alcohol was dissolved in a mixed solvent of 15 g of water and 15 g of ethanol to obtain an aqueous coating. The aqueous coating was applied on the above high concentration layer with a wire bar so as to secure a dry coated weight of about 0.3 g/m$^2$ and then dried at 80° C. for 2 minutes to form a low concentration layer. Thereby a dye transfer sheet was obtained.

Figure 4:
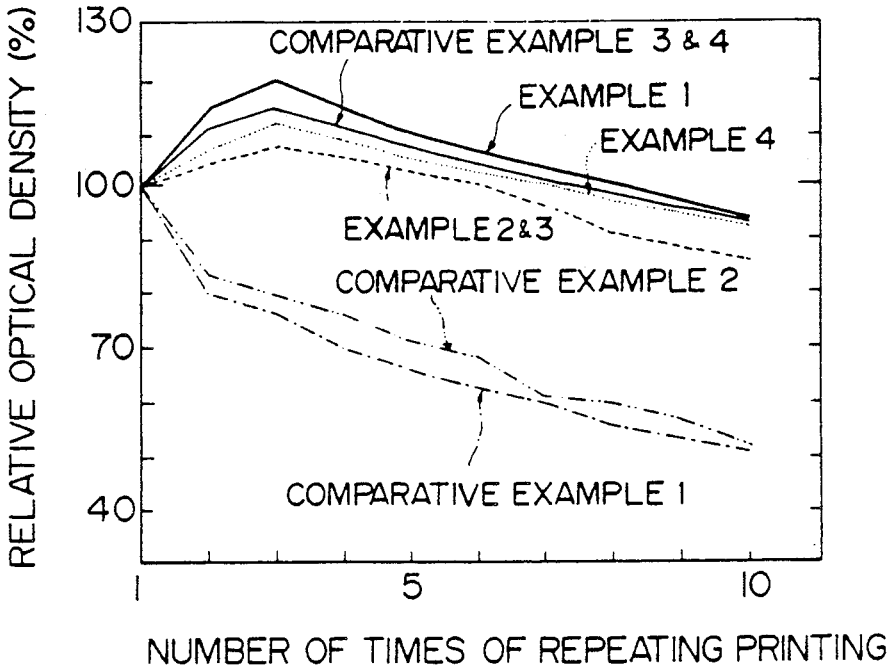
FIGS. 4 and 5 are graphs indicating changes in optical density with the number of times of repeating printing at the same printing energy in the multiple-use mode printing of a simple repeating system.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

Example 2 (do.)

A high concentration layer was formed in the same manner as in Example 1.

In ethylene glycol monobutyl ether, 4 parts by weight of the same macromonomer as in Example 1, 16 parts by weight of styrene, 30 parts by weight of methyl methacrylate, 15 parts by weight of hydroxyethyl methacrylate, 25 parts by weight of isobytyl acrylate and 10 parts by weight of acrylic acid were subjected to solution polymerization to obtain the solution of the acrylic resin on which polydimethylsiloxane was grafted. Triethyl amine was added to the solution to neutralize it. Thereafter water was added to the solution to obtain an emulsion. The emulsion was applied as an aqueous coating on the above high concentration layer with a wire bar so as to secure a dry coated weight of about 0.5 g/m$^2$ and then dried at 80° C. for 2 minutes to form a low concentration layer. Thereby a dye transfer sheet was obtained.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

Example 3 (do.)

A high concentration layer was made in the same manner as in Example 1.

The dispersion liquid of polytetrafluoroethylene microparticles having a particle size of 0.1-0.5 μm (HOSTAFLON TF5032 sold by Hoechst Japan Limited) was added to the same emulsion as in Example 2 so that the microparticles was 30% of all the solid matter. The obtained emulsion was applied as an aqueous coating on the above high concentration layer to form a low concentration layer. Thereby a dye transfer sheet was obtained.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

Example 4 (do.)

A high concentration layer was made in the same manner as in Example 1.

An aqueous coating was prepared by dissolving 5 g of a water dispersible urethane ionomer resin solution having a solid content of 22% by weight (HYDRAN AP40 made by DAINIPPON INK & CHEMICALS, INC.) and 0.02 g of polyvinyl alcohol (GOHSENOL KH-17 made by The Nippon Synthetic Chemical Industry Co., Ltd.) in 12.5 g of water. The aqueous coating was applied on the above high concentration layer so as to secure a dry coated weight of 0.2 g/m$^2$ and the dried to form a low concentration layer.

On the other hand, a prepolymer prepared from 1 part by weight of dimethylol propionic acid, 10 parts by weight of hexanediol, 5 parts by weight of glycerol and 6 parts by weight of tolylenediisocyanate was reacted with a triisocyanate prepared from 30 parts by weight of tolylenediisocyanate and 10 parts by weight of trimethylolpropane in MEK in the presence of the excess amount of isocyanates and further with polydimethylsiloxane having diol groups as both end groups. The resulting reaction mixture was neutralized with an aqueous solution of triethylamine. MEK was distilled off to obtain an emulsion coating. The emulsion coating was applied on the above low concentration layer in the same manner as in Example 2 so as to secure a dry coated weight of 0.2 g/m$^2$ and then dried to form a lubricating layer. Thereby a dye transfer sheet was obtained.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

Comparative Example 1 (do.)

A high concentration layer was formed on a transfer substrate in the same manner as in Example 1, except that the low concentration layer was not made. Thereby a dye transfer sheet was obtained.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

Comparative Example 2 (do.)

A high concentration layer was formed on a transfer substrate in the same manner as in Example 1.

An aqueous coating was prepared by dissolving 1 g of a butyral resin (S-lec BX 1 made by Sekisui Chemical, Co., Ltd.), 0.05 g of a paraffin wax (#155 made by Nippon Seiro Co., Ltd.) and 0.05 g of oleic amide in a mixed solvent of 21 g of toluene and 9 g of MEK. The aqueous coating was applied on the above high concentration layer in the same manner as in Example 1 so as to secure a dry coated weight of 0.8 g/m$^2$ and then dried to form a low concentration layer. Thereby a dye transfer sheet was made. However, after the low concentration layer was formed, the aqueous coating to which a large amount of the dye had moved from the high concentration layer was adhered to the wire bar.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

Comparative Example 3 (do.)

A high concentration layer was formed on a transfer substrate in the same manner as in Example 1. An aqueous coating was prepared by dissolving 1 g of polyvinyl alcohol obtained by saponifying polyvinyl acetate in a degree of saponification of 50% in a mixed solvent of 15 g of water and 15 g of ethanol. The aqueous coating was applied on the above high concentration layer in the same manner as in Example 1 so as to secure a dry coated weight of 0.2 g/m$^2$ and then dried to form a low concentration layer. Thereby a dye transfer sheet was made.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

Comparative Example 4 (do.)

A high concentration layer was formed on a transfer substrate in the same manner as in Example 1. An aqueous coating was prepared by dissolving 1 g of an emulsion of a silicone oil (content of nonvolatile component: 30%) in 6% aqueous solution of a water soluble polyester (POLYESTER WR901 made by The Nippon Synthetic Chemical Industry Co., Ltd.). The aqueous coating was applied on the above high concentration layer in the same manner as in Example 1 so as to secure a dry coated weight of 0.2 g/m$^2$ and then dried to form a low concentration layer. Thereby a dye transfer sheet was obtained. However, the dye transfer sheet was inferior in shelf life and recrystallization occurred at the surface of the coloring material layer in 30 minutes after the production of the sheet.

A printing energy necessary to secure an optical density of about 2.0, the properties of multiple-use mode printing of a simple repeating system using said printing energy and the possibility of a relative speed printing were investigated using the dye transfer sheet. The results are shown in Table 1 and FIG. 4.

TABLE 1

| | Printing energy (J/cm$^2$) | Relative speed printing |
|---|---|---|
| Example 1 | 6.2 | possible |
| Example 2 | 6.2 | good |
| Example 3 | 6.6 | good |
| Example 4 | 6.2 | possible |
| Comparative Example 1 | 4.7 | impossible |
| Comparative Example 2 | 5.2 | possible |
| Comparative Example 3 | 6.2 | impossible |
| Comparative Example 4 | 6.2 | possible |

Example 5 (in the preferred mode (B))

An ink was prepared by dissolving 2.5 g of the dye I, 1.3 g of a butyral resin (S-lec BX-1 made by Sekisui Chemical Co., Ltd.) as a binder polymer and 0.29 g of a polyisocyanate (Coronate L made by Nippon Polyurethane Industry, Co., Ltd.) as a cross-linking agent in a mixed solvent of 21 g of toluene and 9 g of MEK. The ink was applied to a transfer substrate with a wire bar so as to secure a dry coated weight of 3 g/m$^2$ and then dried to form a high concentration layer.

On the other hand, 4 parts by weight of a macromonomer obtained by the transesterification of a polydimethylsiloxane having a diol group at one end and a kinematic viscosity of 79 cSt (X-22-170D made by Shin-Etsu Chemical Co., Ltd.) with methyl methacrylate, 16 parts by weight of styrene, 30 parts by weight of methyl methacrylate, 15 parts by weight of hydroxyethyl methacrylate, 25 parts by weight of isobutyl acrylate and 10 parts by weight of acrylic acid were subjected to solution polymerization in ethylene glycol monobutyl ether as a solvent. Thereby there was obtained the solution of the acrylic resin on which polydimethylsiloxane was grafted. The solution was neutralized with triethylamine. Water was added to the solution to obtain an emulsion. The emulsion was applied to the above high concentration layer with a wire bar so as to secure a dry coated weight of about 0.3 g/m$^2$ and then dried at 80° C.

for 2 minutes to form a low concentration layer. Thereby a dye transfer sheet was obtained.

Figure 5:
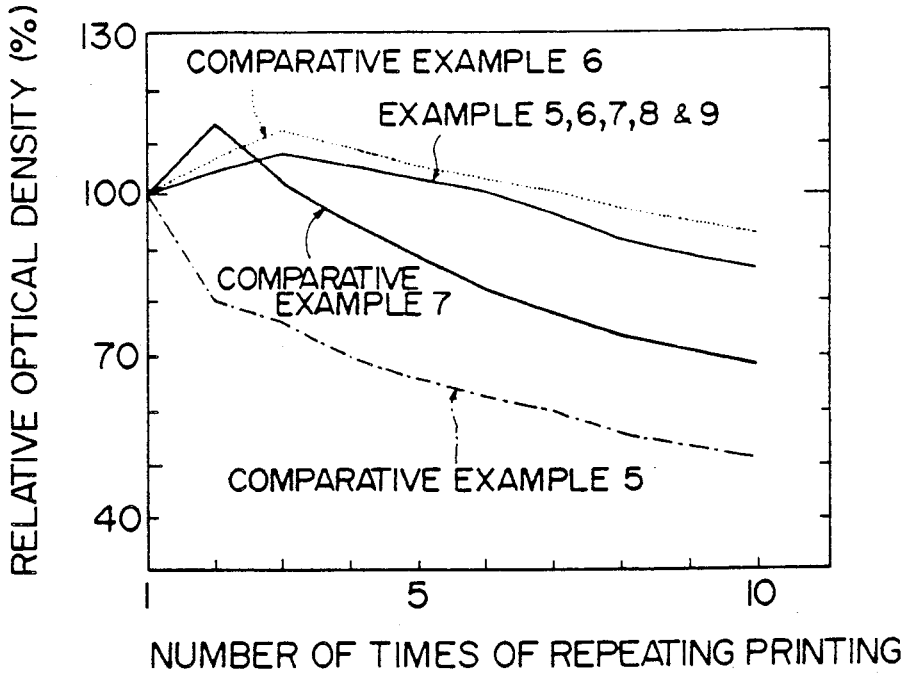

A printing energy necessary to secure an optical density of about 2.0, the properties of multiple-use mode printing of a simple repeating system using said printing energy and the possibility of a relative speed printing, a quality of picture and the deformation of the surface of the dye transfer sheet after the printing were investigated using the dye transfer sheet. The results are shown in Table 2 and FIG. 5.

Example 6 (do.)

An ink was prepared by dissolving 2.5 g of the dye I, 1.3 g of a formal resin (DENKA FORMAL #100 made by DENKI KAGAKU KOGYO K.K.) as a binder polymer and 0.29 g of a polyisocyanate (Coronate L made by Nippon Polyurethane Industry Co., Ltd.) as a cross-linking agent in a mixed solvent of 21 g of toluene and 9 g of MEK. The ink was applied on a transfer substrate with a wire bar so as to secure a dry coated weight of 3 g/m$^2$ and then dried to form a high concentration layer.

An aqueous coating was prepared by dissolving 2 g of a water soluble polyester (POLYESTER WR901 made by The Nippon Synthetic Chemical Industry, Co., Ltd.) in 30 g of water. The aqueous coating was applied on the above high concentration layer with a wire bar so as to secure a dry coated weight of about 0.3 g/m$^2$ and then dried at 80° C. for 2 minutes to form a low concentration layer.

Further, another coating was prepared by dissolving 2 g of a butyral resin (S-lec BMS made by Sekisui Chemical Industry, Co., Ltd.), 0.1 g of an amino-modified silicone oil (KF393 made by Shin-Etsu Chemical Industry, Co., Ltd.) and 0.1 g of an epoxy-modified silicone oil (X-22-343 made by Shin-Etsu Chemical Industry, Co., Ltd.) in 30 g of toluene. The coating was allowed to stand for 3 days and thereafter applied on the above low concentration layer with a wire bar so as to secure a dry coated weight of about 0.3 g/m$^2$ to form a lubricating layer having lubricity. Thereby a dye transfer sheet was obtained.

A printing energy necessary to secure an optical density of about 2.0, the properties of multiple-use mode printing of a simple repeating printing system using said printing energy and the possibility of a relative speed printing, a quality of picture and the deformation of the surface of the dye transfer sheet after the printing were investigated using the dye transfer sheet. The results are shown in Table 2 and FIG. 5.

Example 7 (do.)

An ink was prepared by dissolving 2.5 g of the dye I, 1.4 g of a saturated polyester resin (Vyron 290 made by TOYOBO CO., LTD.) as a binder polymer and 0.14 g of a polyisocyanate (Coronate L made by Nippon Polyurethane Industry Co.,,Ltd.) as a cross-linking agent in a mixed solvent of 21 g of toluene and 9 g of MEK. The ink was applied on a transfer substrate with a wire bar so as to secure a dry coated weight of 3 g/m$^2$ and then dried to form a high concentration layer.

The emulsion prepared in Example 5 was applied on the above high concentration layer in the same manner as in Example 5 to form a low concentration layer. Thereby a dye transfer sheet was obtained.

A printing energy necessary to secure an optical density of about 2.0, the properties of multiple-use mode printing of a simple repeating system using said printing energy and the possibility of a relative speed printing, a quality of picture and the deformation of the surface of the dye transfer sheet after the printing were investigated using the dye transfer sheet. The results are shown in Table 2 and FIG. 5.

Example 8 (do.)

An ink was prepared by dissolving 2.5 g of the dye I, 1.4 g of a butyral resin (S-lec BX-1 made by Sekisui Chemical Industry, Co., Ltd.) as a binder polymer and 0.1 g of glyoxal as a cross-linking agent in a mixed solvent of 21 g of toluene and 9 g of MEK. The ink was applied on a transfer substrate with a wire bar so as to secure a dry coated weight of 3 g/m$^2$ and then dried to form a high concentration layer.

The emulsion prepared in Example 5 was applied on the above high concentration layer in the same manner as in Example 5 to form a low concentration layer. Thereby a dye transfer sheet was obtained.

A printing energy necessary to secure an optical density of about 2.0, the properties of multiple-use mode printing of a simple repeating system using said printing energy and the possibility of a relative speed printing, a quality of picture and the deformation of the surface of the dye transfer sheet after the printing were investigated using the dye transfer sheet. The results are shown in Table 2 and FIG. 5.

Example 9 (do.)

An ink was prepared by dissolving 2.5 g of the dye I, 1.3 g of a butyral resin (S-lec BX-1 made by Sekisui Chemical Industry, Co., Ltd.) as a binder polymer, 0.2 g of an epoxy resin (EPICOAT 827 made by Shell Chemical Co.) and 0.05 g of phthalic anhydride in a mixed solvent of 21 g of toluene and 9 g of a MEK. The ink was applied on a transfer substrate with a wire bar so as to secure a dry coated weight of 3 g/m$^2$ and then dried to form a high concentration layer.

The emulsion prepared in Example 5 was applied on the above high concentration layer in the same manner as in Example 5 to form a low concentration layer. Thereby a dye transfer sheet was obtained.

A printing energy necessary to secure an optical density of about 2.0, the properties of multiple-use mode printing of a simple repeating system using the same printing energy and the possibility of a relative speed printing, a quality of picture and the deformation of the surface of the dye transfer sheet after the printing were investigated using the dye transfer sheet. The results are shown in Table 2 and FIG. 5.

Comparative Example 5 (do.)

A high concentration layer was formed on a transfer substrate in the same manner as in Example 5, except that a low concentration layer was not formed. Thereby a dye transfer sheet was made.

A printing energy necessary to secure an optical density of about 2.0, the properties of multiple-use mode printing of a simple repeating system using said printing energy and the possibility of a relative speed printing, a quality of picture and the deformation of the surface of the dye transfer sheet after the printing were investigated using the dye transfer sheet. The results are shown in Table 2 and FIG. 5.

Comparative Example 6 (do.)

An ink was prepared by dissolving 2.5 g of the dye I and 1.5 g of a butyral resin (S-lec BX-1 made by Sekisui Chemical Industry, Co., Ltd.) as a binder polymer in a mixed solvent of 21 g of toluene and 9 g of MEK. The ink was applied on a transfer substrate with a wire bar so as to secure a dry coated weight of 3 g/m$^2$ and then dried to form a high concentration layer.

The emulsion prepared in Example 5 was applied on the above high concentration layer in the same manner as in Example 5 to form a low concentration layer. Thereby a dye transfer sheet was made.

A printing energy necessary to secure an optical density of about 2.0, the properties of multiple-use mode printing of a simple repeating system using said printing energy and the possibility of a relative speed printing, a quality of picture and the deformation of the surface of the dye transfer sheet after the printing were investigated using the dye transfer sheet. The results are shown in Table 2 and FIG. 5.

Comparative Example 7 (do.)

An ink was prepared by dissolving 2.5 g of the dye I and 1.5 g of a polysulfon (P-1700 made by Nissan Chemical Industries, Ltd.) as a binder polymer in a mixed solvent of 21 g of toluene and 9 g of MEK. The ink was applied on a transfer substrate with bar so as to secure a dry coated weight of 3 g/m$^2$ and then dried to form a high concentration layer.

The emulsion prepared in Example 5 was applied on the above high concentration layer in the same manner as in Example 5 to form a low concentration layer. Thereby a dye transfer sheet was made.

A printing energy necessary to secure an optical density of about 2.0, the properties of multiple-use mode printing of a simple repeating system using said printing energy and the possibility of a relative speed printing, a quality of picture and the deformation of the surface of the dye transfer sheet after the printing were investigated using the dye transfer sheet. The results are shown in Table 2 and FIG. 5.

TABLE 2

| | Printing energy (J/cm$^2$) | Relative speed printing | Quality of picture | Deformation of the surface of dye transfer sheet |
|---|---|---|---|---|
| Example 5 | 6.0 | good | good | no |
| Example 6 | 6.0 | possible | good | no |

TABLE 2-continued

| | Printing energy (J/cm$^2$) | Relative speed printing | Quality of picture | Deformation of the surface of dye transfer sheet |
|---|---|---|---|---|
| Example 7 | 6.0 | good | good | no |
| Example 8 | 6.0 | good | good | no |
| Example 9 | 6.0 | good | good | no |
| Comparative Example 5 | 4.2 | impossible | — | greatly deformed |
| Comparative Example 6 | 6.0 | possible | bad | greatly deformed |
| Comparative Example 7 | 6.8 | possible | good | slightly deformed |

What is claimed is:

1. A dye transfer sheet consisting of a transfer substrate and a coloring material layer comprising a high concentration layer which comprises a dye for dye diffusion thermal printing and a binder polymer and is formed on the transfer substrate and a low concentration layer which comprises a water soluble resin or water dispersible resin that is a graft copolymer of polydimethylsiloxane and has a lower dye concentration than the high concentration layer and is formed on the high concentration layer.

2. A dye transfer sheet according to claim 1, wherein the coloring material layer has a lubricating layer of a water soluble resin or water dispersible resin that is a graft copolymer of polydimethylsiloxane on the low concentration layer.

3. A dye transfer sheet according to claim 1, wherein the low concentration layer contains microparticles of tetrafluorethylene.

4. A dye transfer sheet consisting of a transfer substrate and a coloring material layer comprising a high concentration layer which comprises a dye for dye diffusion thermal printing and a binder polymer cross-linked with a cross-linking agent and is formed on the transfer substrate and a low concentration layer which comprises a water soluble resin or water dispersible resin that is a graft copolymer of polydimethylsiloxane and has a lower dye concentration than the high concentration layer and is formed on the high concentration layer.

5. A dye transfer sheet according to claim 4, wherein the binder polymer is selected from the group consisting of polyvinyl formals, polyvinyl acetals and polyvinyl butyrals and the cross-linking agent is selected from the group consisting of polyisocyanates, phenol resins, melamine resins, epoxy resins and polyaldehydes.

* * * * *